US010295162B2

(12) United States Patent
Habchi

(10) Patent No.: US 10,295,162 B2
(45) Date of Patent: May 21, 2019

(54) MODULAR LIGHT BULB WITH QUICK AND EASILY USER-REPLACEABLE INDEPENDENT COMPONENTS

(71) Applicant: Philippe Georges Habchi, Long Beach, CA (US)

(72) Inventor: Philippe Georges Habchi, Long Beach, CA (US)

( * ) Notice: Subject to any disclaimer, the term of this patent is extended or adjusted under 35 U.S.C. 154(b) by 361 days.

(21) Appl. No.: 14/918,502

(22) Filed: Oct. 20, 2015

(65) Prior Publication Data

US 2017/0108203 A1 Apr. 20, 2017

(51) Int. Cl.

| | |
|---|---|
| ***F21V 23/00*** | (2015.01) |
| ***F21V 29/83*** | (2015.01) |
| ***F21K 9/90*** | (2016.01) |
| ***F21V 29/508*** | (2015.01) |
| ***F21V 29/77*** | (2015.01) |
| ***F21V 17/06*** | (2006.01) |
| ***F21K 9/232*** | (2016.01) |
| ***F21K 9/238*** | (2016.01) |
| *F21Y 115/10* | (2016.01) |
| *F21Y 107/00* | (2016.01) |

(52) U.S. Cl.

CPC ..... *F21V 23/009* (2013.01); *F21K 9/232* (2016.08); *F21K 9/238* (2016.08); *F21K 9/90* (2013.01); *F21V 17/06* (2013.01); *F21V 29/508* (2015.01); *F21V 29/777* (2015.01); *F21V 29/83* (2015.01); *F21Y 2107/00* (2016.08); *F21Y 2115/10* (2016.08)

(58) Field of Classification Search

CPC ..... F21V 33/056; F21V 23/06; F21V 17/00; F21V 19/008; F21V 3/00; F21V 15/02; F21V 17/002; F21V 17/10; F21V 17/12; F21V 23/003; F21V 23/007; F21V 23/009; F21S 4/001; F21K 9/1355; F21K 9/23; F21K 9/237; F21K 9/238

USPC ..... 362/363, 385

See application file for complete search history.

(56) References Cited

U.S. PATENT DOCUMENTS 6,152,582 A * 11/2000 Klaus ..... F21S 8/088 362/363
7,559,674 B2 * 7/2009 He ..... F21K 9/23 315/169.1
7,866,838 B2 * 1/2011 Wang ..... F21V 29/20 362/249.02

(Continued)

FOREIGN PATENT DOCUMENTS

CA 2604364 3/2008

OTHER PUBLICATIONS

Tim Whitaker, Zhaga, and Joseph Frederic, UL; Replacement Light Sources and Zhaga Specifications; Online Article; Posted Oct. 21, 2014; http://www.zhagastandard.org/features/120/replaceable-light-sources-and-zhaga-specifications.

*Primary Examiner* — Ismael Negron
(74) *Attorney, Agent, or Firm* — Mu P.C.

(57) ABSTRACT

A light bulb includes a light source unit, an optical unit enclosing the light source unit, a chassis unit having an upper chassis part and a lower chassis part releasably fastened to one another a driver unit received within the chassis unit and configured to drive the light source unit, and a base unit engageable with a light bulb socket and coupled to the driver unit. The driver unit, the base unit, the light source unit, and the optical unit are configured for easy and quick independent replacement by a user of the light bulb.

20 Claims, 12 Drawing Sheets

(56) References Cited

U.S. PATENT DOCUMENTS 8,246,202 B2 * 8/2012 Mart ..... F21K 9/233 362/249.01
8,246,221 B2 * 8/2012 Hashimoto ..... H05B 33/0803 362/249.02
8,319,437 B2 11/2012 Carlin et al.
8,403,541 B1 3/2013 Rashidi
8,829,774 B1 * 9/2014 Shum ..... F21K 9/90 313/46
8,836,231 B2 9/2014 Bradford
8,882,303 B2 * 11/2014 Totani ..... F21V 29/74 362/294
8,905,580 B2 * 12/2014 Jang ..... F21V 3/00 362/235
8,975,806 B2 * 3/2015 Kitagawa ..... F21V 3/02 313/110
9,562,651 B2 * 2/2017 Echigo ..... F21V 3/00
2005/0254246 A1 * 11/2005 Huang ..... F21V 15/01 362/362
2006/0050514 A1 * 3/2006 Opolka ..... F21V 29/004 362/294
2006/0075422 A1 * 4/2006 Choi ..... G01S 3/7864 725/18
2006/0114695 A1 * 6/2006 Tseng ..... H01R 33/09 362/659
2011/0109218 A1 * 5/2011 Giacomin ..... F21V 29/004 313/46
2012/0244732 A1 * 9/2012 Fullerton ..... H01R 13/6205 439/236
2014/0078719 A1 * 3/2014 Jung ..... H05K 5/02 362/97.1
2014/0103794 A1 * 4/2014 Ueda ..... F21K 9/1355 313/318.01
2014/0153259 A1 * 6/2014 Lee ..... F21K 9/135 362/363
2014/0211477 A1 7/2014 Anderson
2014/0355246 A1 * 12/2014 Yotsumoto ..... F21V 23/006 362/86
2015/0098229 A1 * 4/2015 Tamura ..... F21V 23/007 362/382

* cited by examiner

MODULAR LIGHT BULB WITH QUICK AND EASILY USER-REPLACEABLE INDEPENDENT COMPONENTS

TECHNICAL FIELD

The present disclosure generally relates to light bulbs. In particular, a modular light bulb and a method of assembling the modular light bulb are presented.

BACKGROUND

Light bulbs have been used for decades as a means to provide illumination and come in various forms. Typically, today's light bulbs are manufactured in a permanent manner by assembling the bulb components with the use of adhesive and soldering. For example, adhesive material or thermal bonding is used to fasten an optical lens onto a bulb chassis and to fasten a base to the other end of the bulb chassis. Also, wires are used to electrically connect the base to a light source driver as well as the light source driver to a light source within the bulb, wherein the ends of the wires are soldered at respective soldering points of these components. Typically, four soldering points for electrically connecting the base to the driver and four soldering points for electrically connecting the driver to the light source are required. Due to such permanent assembly, when a bulb breaks, the entire assembly needs to be thrown away. This may entail a waste of material because the components of the light bulb may have differing life spans. Components which may still be in good working condition are thus trashed unnecessarily.

SUMMARY

Accordingly, there is a need for a light bulb that avoids waste of material when the bulb breaks.

According to a first aspect, a modular light bulb is provided. The modular light bulb comprises a light source unit, an optical unit enclosing the light source unit, a driver unit configured to drive the light source unit, a base unit engageable with a light bulb socket, and a chassis unit having an upper chassis part and a lower chassis part releasably fastened to one another. The driver unit is removably accommodated within the chassis unit and has a releasable electrical connection to the base unit passing through the lower chassis part and a releasable electrical connection to the light source unit passing through the upper chassis part. The base unit is releasably fastened onto the lower chassis part, the light source unit is releasably fastened onto the upper chassis part, and the optical unit is releasably fastened onto the chassis unit. The optical unit may be releasably fastened onto at least one of the upper chassis part and the lower chassis part.

The releasable electrical connection between the driver unit and the light source unit may comprise at least one plug and socket connection. In one variant, the releasable electrical connection between the driver unit and the light source unit may comprise a plug and socket connection formed between the driver unit and the light source unit. In another variant, the modular light bulb may further comprise an adapter unit for electrically connecting the driver unit to the light source unit. In this case, the releasable electrical connection between the driver unit and the light source unit may comprise a plug and socket connection formed between the driver unit and the adapter unit and a plug and socket connection formed between the adapter unit and the light source unit.

In each such plug and socket connection, a plug may be formed of two rigid conductors which extend from one unit into a socket formed at the other unit. In one such variant, a plug for a plug and socket connection may be formed of two rigid conductors extending from the light source unit. In this case, the plug may extend into a socket formed at the driver unit. If an adapter unit is used, the plug may extend into a socket formed at the adapter unit. In another variant, a socket may be formed at the light source unit, wherein the socket receives a plug formed of two rigid conductors extending from the driver unit or the adapter unit, respectively. It will be understood that such variants may apply to the plug and socket connection between the driver unit and to the adapter unit as well.

The base unit may comprise a first portion and a second portion electrically isolated from one another. The releasable electrical connection between the driver unit and the base unit may comprise a first rigid conductor extending from the driver unit and contacting the first portion of the base unit and a second rigid conductor extending from the driver unit and contacting the second portion of the base unit. In one variant, the first rigid conductor may be received in a retaining hole formed at the first portion of the base unit.

The base unit may be fastened to the lower chassis part using a form-lock between the second portion of the base unit and the lower chassis part. In this case, the second rigid conductor may be wrapped around the lower chassis part to extend into a groove formed at the outside of the lower chassis part in a region of the form-lock so that the second rigid conductor is sandwiched between the second portion of the base unit and the lower chassis part.

Further, the driver unit may be enclosed in an insert fitting into the chassis unit. If an adapter unit for electrically connecting the driver unit to the light source unit is used, the adapter unit may be enclosed in the insert as well.

For heat dissipation purposes, the insert may include at least one aperture for heat dissipation. Also, the chassis unit may have heatsink characteristics and comprise fins for heat dissipation on its outside. Moreover, when the optical unit is fastened to the chassis unit using a form-lock, at least one of the chassis unit and the optics unit may comprise at least one groove in a region of the form-lock so that the at least one groove forms an aperture for heat dissipation.

A releasable locking mechanism may be used for releasably fastening at least one of the upper chassis part and the lower chassis part to one another, the base unit onto the lower chassis part, the light source unit onto the upper chassis part, and the optical unit onto the chassis unit.

According to a second aspect, a method of assembling a modular light bulb is provided. The method comprises inserting a driver unit into a chassis unit having an upper chassis part and a lower chassis part, the upper chassis part and the lower chassis part being configured to be releasably fastened to one another, fastening the upper chassis part and the lower chassis part to one another, fastening a base unit onto the lower chassis part, the base unit and the lower chassis part being configured to be releasably fastened to one another, wherein fastening the base unit onto the lower chassis part comprises establishing a releasable electrical connection between the base unit and the driver unit, the base unit being engageable with a light bulb socket, fastening a light source unit onto the upper chassis part, the light source unit and the upper chassis part being configured to be releasably fastened to one another, wherein fastening the light source unit onto the upper chassis part comprises establishing a releasable electrical connection between the driver unit and the light source unit, the driver unit being configured to drive the light source unit, and fastening an optical unit onto the chassis unit, the optical unit and the chassis unit being configured to be releasably fastened to one another, so that the optical unit encloses the light source unit.

According to a third aspect, a light source unit for use in a modular light bulb is provided. The light source unit is configured to be releasably fastened to a chassis unit of the modular light bulb and comprises one of a plug and a socket for establishing a releasable electrical connection to a driver unit of the modular light bulb for driving the light source unit using a plug and socket connection. The plug may comprise two rigid conductors extending from the light source unit. The light source unit may be configured to be releasably fastened to the chassis unit using a releasable locking mechanism.

According to a fourth aspect, a driver unit for use in a modular light bulb is provided. The driver unit is configured to be removably accommodated within a chassis unit of the modular light bulb and configured to drive a light source unit of the modular light bulb, wherein the driver unit comprises one of a plug and a socket for establishing a releasable electrical connection to the light source unit using a plug and socket connection. The plug may comprise two rigid conductors extending from the driver unit. The driver unit may further comprise a first rigid conductor extending from the driver unit for contacting a first portion of a base unit of the modular light bulb and a second rigid conductor extending from the driver unit for contacting a second portion of the base unit of the modular light bulb. The driver unit may be enclosed in an insert fitting into a chassis unit of the modular light bulb. An adapter unit for electrically connecting the driver unit to the light source unit may be enclosed in the insert. The insert may include at least one aperture for heat dissipation.

According to a fifth aspect, an adapter unit for electrically connecting a driver unit of a modular light bulb to a light source unit of the modular light bulb is provided. The adapter unit comprises one of a plug and a socket for establishing a releasable electrical connection from the adapter unit to the driver unit using a plug and socket connection and one of a plug and a socket for establishing a releasable electrical connection from the adapter unit to the light source unit using a plug and socket connection.

According to a sixth aspect, a base unit for use in a modular light bulb is provided. The base unit is configured to be releasably fastened to a chassis unit of the modular light bulb and being engageable with a light bulb socket, wherein the base unit comprises a first portion and a second portion electrically isolated from one another. A retaining hole for receiving a first rigid conductor from a driver unit of the modular light bulb may be formed at the first portion of the base unit to establish a releasable electrical connection to the driver unit. The base unit may be configured to be releasably fastened to the chassis unit using a releasable locking mechanism.

According to a seventh aspect, a chassis unit for use in a modular light bulb is provided. The chassis unit has an upper chassis part and a lower chassis part configured to be releasably fastened to one another, wherein the chassis unit is configured to removably accommodate therein a driver unit of the modular light bulb, wherein the lower chassis part is configured to releasably fasten thereon a base unit of the modular light bulb, wherein the upper chassis part is configured to releasably fasten thereon a light source unit of the modular light bulb, and wherein the chassis unit is configured to releasably fasten thereon an optical unit of the modular light bulb. The lower chassis part may be fastened to the base unit using a form-lock, wherein a groove may be formed at the outside of the lower chassis part in a region of the form-lock so that a rigid conductor of the driver unit is sandwichable between the base unit and the lower chassis part. The chassis unit may further have heatsink characteristics and comprise fins for heat dissipation on its outside. The optical unit may be fastened to the chassis unit using a form-lock, wherein the chassis unit may comprise at least one groove in a region of the form-lock so that the at least one groove forms an aperture for heat dissipation. The upper chassis part and the lower chassis part may be configured to be releasably fastened to one another using a releasable locking mechanism, the lower chassis part may be configured to be releasably fastened to the base unit using a releasable locking mechanism, the upper chassis part may be configured to be releasably fastened to the light source unit using a releasable locking mechanism, and the chassis unit may be configured to be releasably fastened to the optical unit using a releasable locking mechanism.

BRIEF DESCRIPTION OF THE DRAWINGS

An exemplary embodiment of a modular light bulb according to the present disclosure is described herein below with reference to the accompanying drawings, in which.

DETAILED DESCRIPTION

In the following description, for purposes of explanation and not limitation, specific details are set forth in order to provide a thorough understanding of the present disclosure. It will be apparent to one skilled in the art that the present disclosure may be practiced in other embodiments that depart from these specific details.

Figure 1:
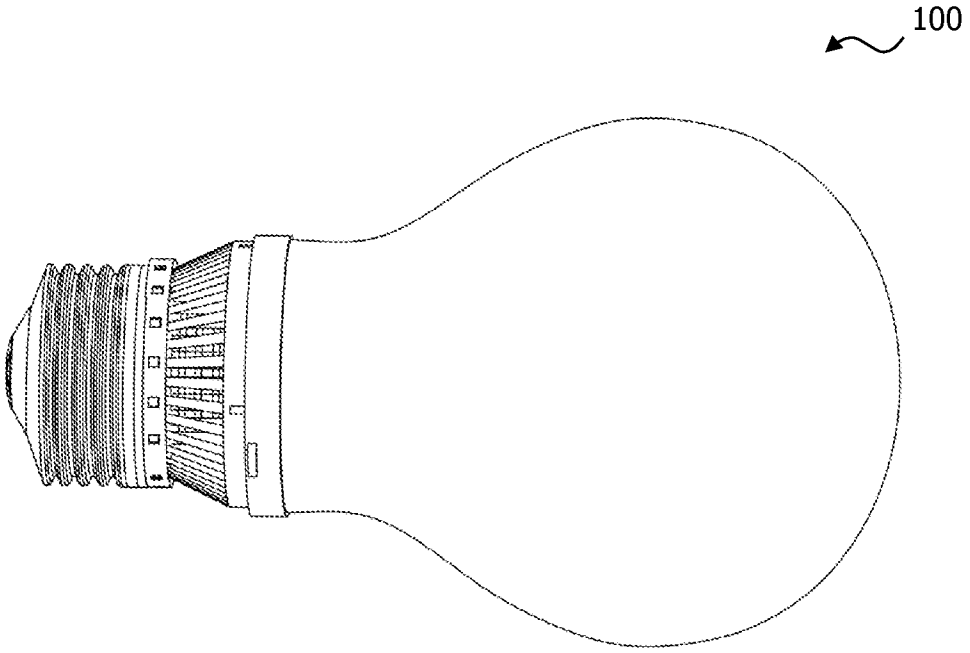
FIG. 1 illustrates the modular light bulb in a perspective view.

FIG. 1 illustrates an exemplary embodiment of a modular light bulb 100. The modular light bulb 100 is illustrated as an A-Series bulb, also known as an Edison lamp. The modular light bulb 100 may be an indoor or an outdoor light bulb.

Light bulbs may generally come in a range of shapes, sizes and bases with names that may consist of one or more letters followed by one or more numbers that may vary in different countries. The letters represent the type of bulb which is known as the "series" and the numbers represent the diameter either in inch or in millimeters depending on the shape and the country. It will be readily apparent to one of ordinary skill in the art that the principles of the present disclosure can be practiced using other series, shapes and types such as, for example, PS-Series, B-Series, C-Series, CA-Series, RP-Series, S-Series, F-Series, PRISM-Series, R-Series, MR-Series, BR-Series, ER-Series, G-Series, H-Series, P-Series, PS-Series, S-Series, T-Series, BT-Series, E-Series, ED-Series, AR-Series, PAR-Series, SPECIALTY-Series or similar light bulbs that may operate under the principles of the present disclosure.

Figure 2:
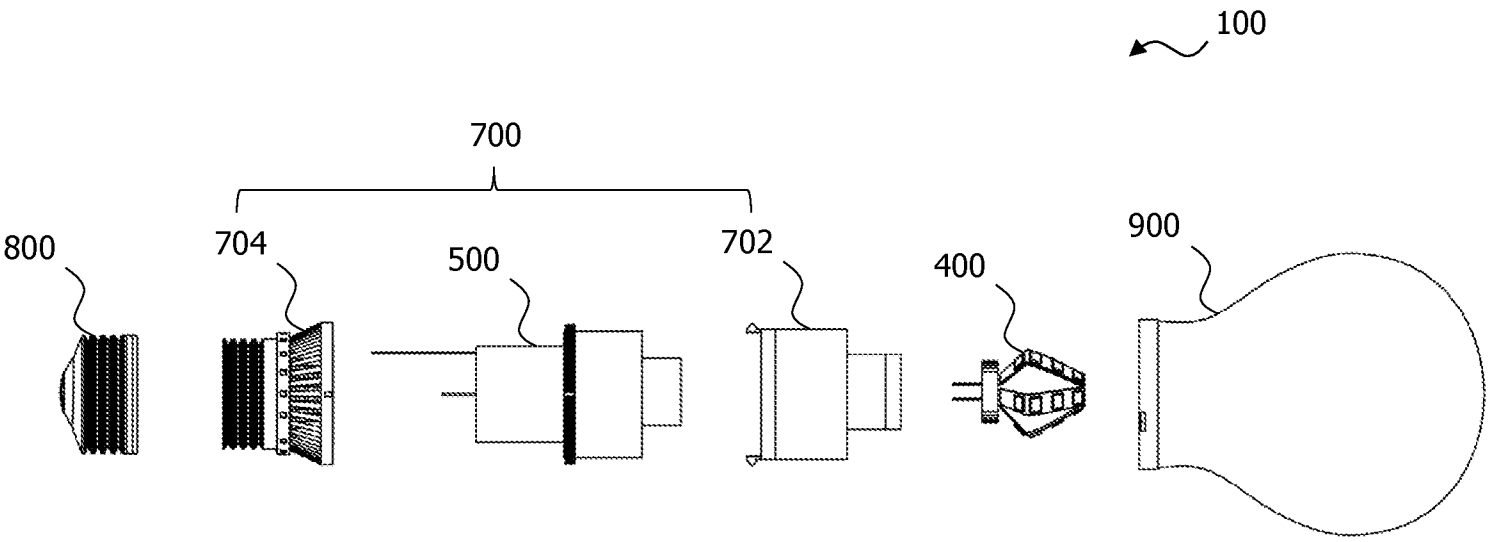
FIG. 2 illustrates the modular light bulb in a disassembled state.
Figure 3:
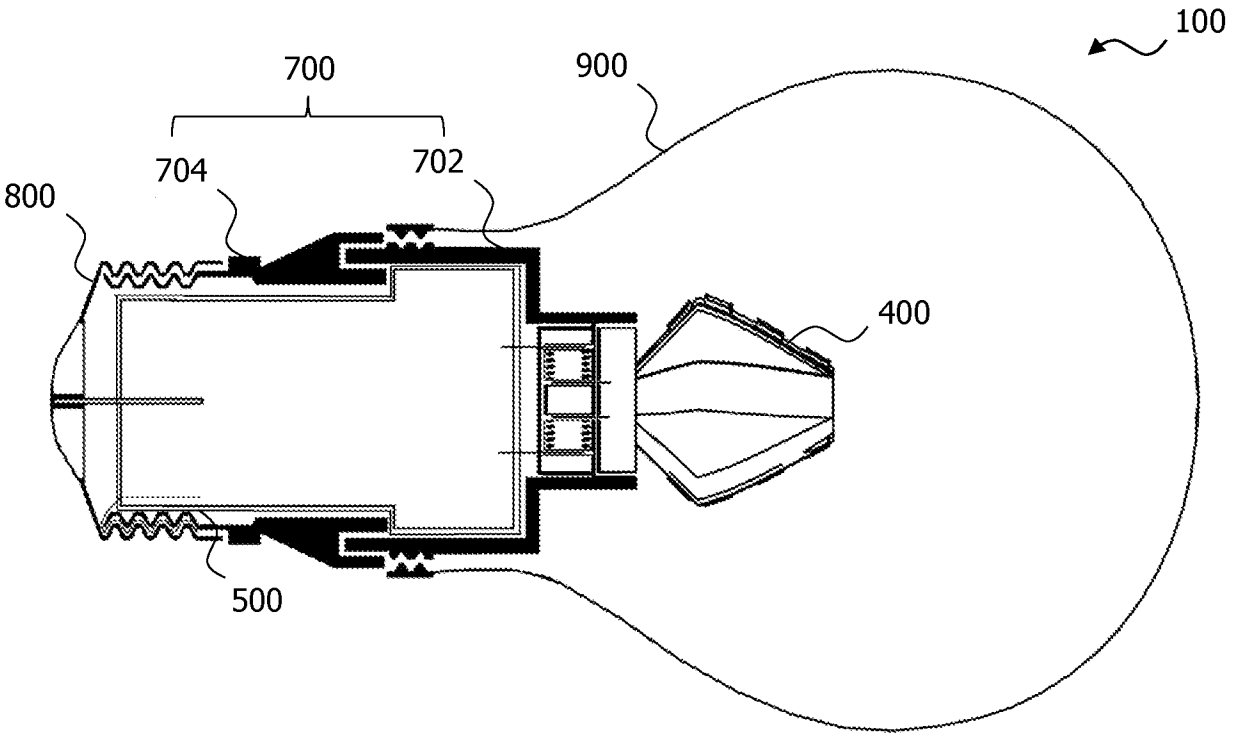
FIG. 3 illustrates the modular light bulb in an assembled state in a cross-sectional view.

FIGS. 2 and 3 illustrate the modular light bulb 100 in a disassembled and an assembled state, respectively. As may be seen in these figures, the modular light bulb 100 comprises several independent components which can be assembled and disassembled in an adhesive-less, solder-less and tool-less manner, as will be explained in more detail below. The components include a light source unit 400, an (insert enclosed) driver unit 500 configured to drive the light source unit 400, a chassis unit 700 having an upper chassis part 702 and a lower chassis part 704 configured to be releasably fastened to one another, a base unit 800 engageable with a light bulb socket, and an optical unit 900 for enclosing the light source unit 400. Each of the components will be described in more detail below with reference to FIGS. 4 to 11.

Figure 4:
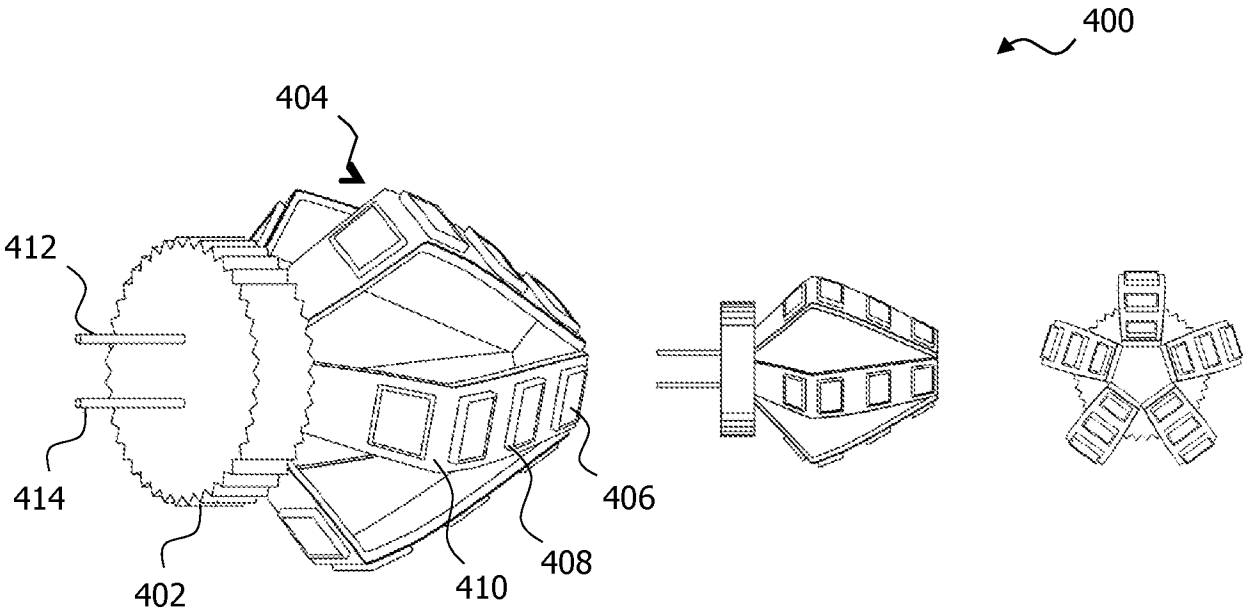
FIG. 4 illustrates the light source unit of the modular light bulb in different perspective views.

FIG. 4 illustrates the light source unit 400 of the modular light bulb 100 in different perspective views. The light source unit 400 is an independent component which may be manufactured and offered separately. The light source unit 400 is configured to emit light and uses Light Emitting Diode (LED) technology in the exemplary embodiment described herein. It will be readily apparent to one of ordinary skill in the art, however, that the principles of the present disclosure can be practiced using other light-emitting technologies, such as, for example, Light Emitting Plasma (LEP), Light Emitting Filament (LEF) or similar light emitting technologies. The employed light emitting technology may generally comprise integrated optical components to shape its radiation pattern, reflective material, conductors, glue and other material required to implement its light emitting characteristic.

In the exemplary embodiment described herein, the light source unit 400 comprises a base 402 from which a plurality of light source strips 404 extend upwards to form a diamond shape that allows deflecting light upwards for a wide beam angle. Each light source strip 404 comprises a plurality of LEDs 406, wherein each LED 406 is held in place using a Surface Mounted Device (SMD) 408. Each light source strip 404 comprises a semi-flexible Printed Circuit Board (PCB) 410 that connects a plurality of SMDs 408 together.

For releasably fastening the light source unit 400 onto the upper chassis part 702 in the exemplary embodiment described herein, the base 402 of the light source unit 400 has precise measurements to fit into a slot 718 (shown in FIG. 7) formed at the upper chassis part 702 to form an interference fit therewith when plugged into the slot 718. The light source unit 400 further comprises two rigid conductors 412 and 414 extending from the light source unit 400. The rigid conductors 412 and 414 may be used to establish electrical connectivity to the driver unit 500. In the exemplary embodiment shown, the rigid conductors 412 and 414 extend from the base 402 into an opposite direction as the light source strips 404.

Figure 5:
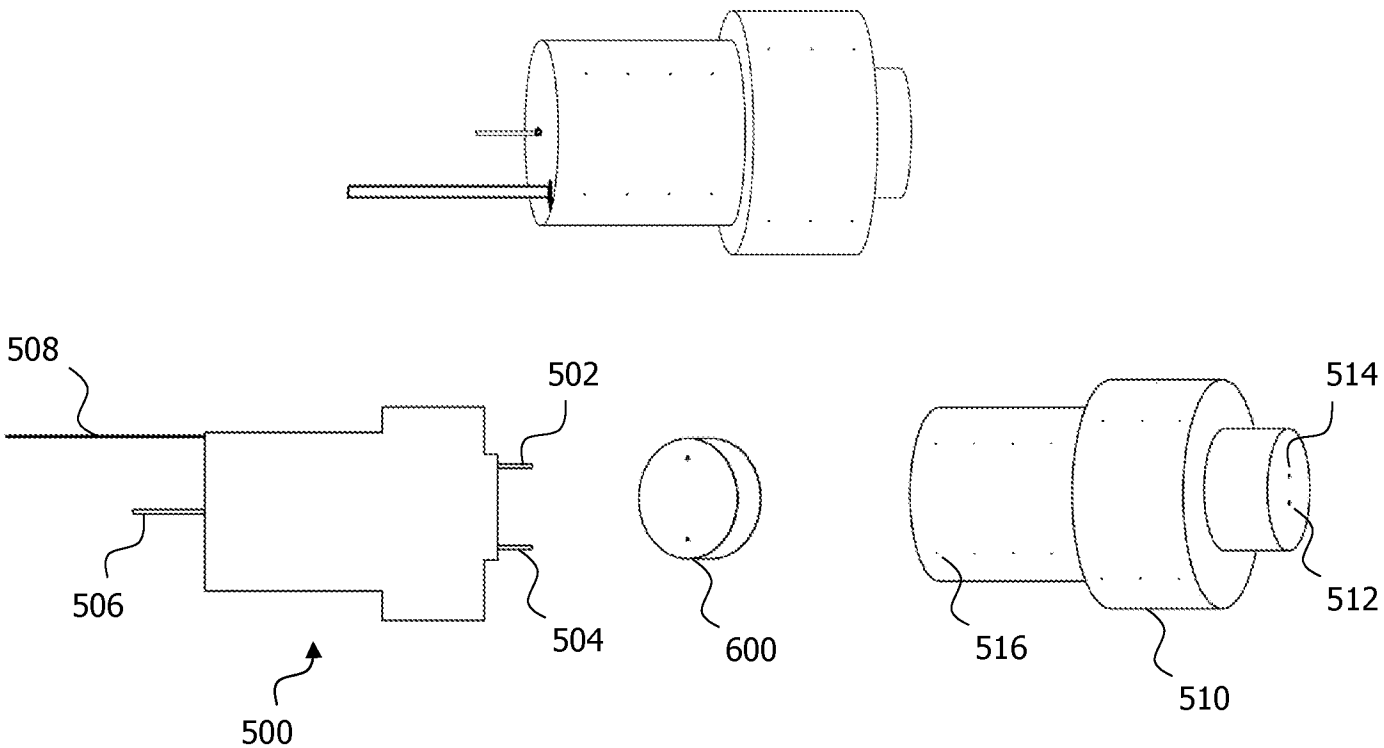
FIG. 5 illustrates the driver unit of the modular light bulb and an insert in which the driver unit is enclosed.

FIG. 5 illustrates the driver unit 500 of the modular light bulb 100. The driver unit 500 is an independent component which may be manufactured and offered separately. The driver unit 500 has a power management function and may be responsible for at least one of routing, regulating and converting current received from a light bulb socket via the base unit 800 to the light source unit 400. For example, the driver unit 500 may receive current from a light bulb socket via the base unit 800 at AC, for example at 110V or 220V or another voltage depending on the country, and may convert and route the current to the light source unit 400 at DC, for example at 12V. In another example, the driver unit 500 may transfer current at DC (e.g., received at DC from an external driver) to the light source unit 400 at DC without converting and regulating the current. As illustrated in FIG. 5, the driver unit 500 may have a flat shape and may come in the form of a Printed Circuit Board (PCB).

The driver unit 500 comprises two rigid conductors 502 and 504 extending therefrom at a side facing the light source unit 400. The rigid conductors 502 and 504 may be used to establish electrical connectivity to the light source unit 400. The driver unit 500 further comprises two rigid conductors 506 and 508 extending at a side facing the base unit 800. The rigid conductors 506 and 508 may be used to establish electrical connectivity to the base unit 800.

For removably accommodating the driver unit 500 within the chassis unit 700 in the exemplary embodiment described herein, the driver unit 500 is enclosed in an insert 510 which fits into the chassis unit 700. The driver unit 500 may have precise measurements that fit into an inner structure of the insert 510 for holding the driver unit 500 in place. The insert 510, in turn, may have precise measurements that fit into the chassis unit 500, for example, using an edge to edge fit. Thus, once the insert 510 is inserted into the chassis unit 700 and the upper chassis part 702 and the lower chassis part 704 are fastened together, the insert 510 is automatically fastened into position.

The insert 510 provides a protective compartment for the driver unit 500, facilitates the overall modularity of the light bulb 100 and simplifies assembly of the driver unit 500 into the chassis unit 700. As such, it is conceivable to provide the driver unit 500 and the insert 510 in a pre-assembled manner as an "insert enclosed driver unit" which can be manufactured, pre-assembled and offered as an independent component. Such "insert enclosed driver unit" is depicted in the upper portion of FIG. 5.

In the exemplary embodiment described herein, the driver unit 500 is electrically connectable to the light source unit 400 via an adapter unit 600 (described with reference to FIG. 6 below). The adapter unit 600 may be plugged onto the rigid conductors 502 and 504 of the driver unit 500 before inserting the driver unit 500 into the insert 510 so that the adapter unit 600 is enclosed within the insert 510 at an end portion of the insert 510 which faces the light source unit 400. Two holes 512 and 514 are provided at the side of the insert 510 facing the light source unit 400 which align with socket holes 602 and 604 of the adapter unit 600 so that the rigid conductors 412 and 414 of the light source unit 400 may be plugged into the adapter unit 600 through the holes 512 and 514. For heat dissipation purposes, the insert 510 may include apertures 516 to allow heat generated by the driver unit 500 to dissipate out of the insert 510.

It will be understood that enclosing the driver unit 500 by an insert 510 that fits into the chassis 700 is just one example of accommodating the driver unit 500 within the chassis unit 700. It will be readily apparent to one of ordinary skill in the art that other ways of accommodating the driver unit 500 within the chassis unit 700 are conceivable. For example, guides may be provided at the inner walls of the upper chassis part 702 and the lower chassis part 704 along which the edges of the driver unit 500 may be slid into the chassis unit 700 and through which the driver unit 500 may be retained within the chassis unit 700.

Figure 6:
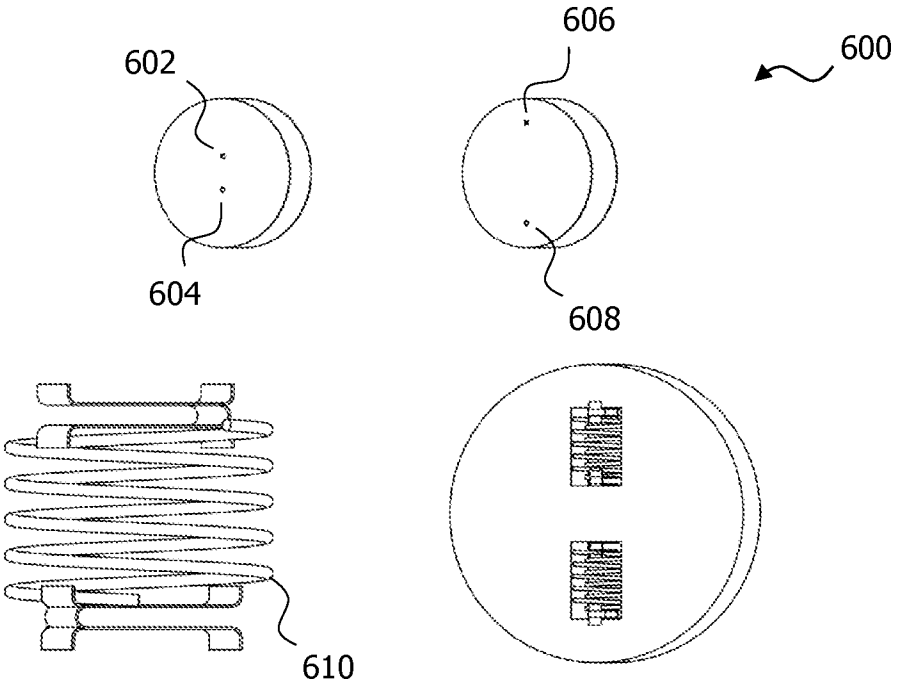
FIG. 6 illustrates the adapter unit of the modular light bulb.

FIG. 6 illustrates the adapter unit 600 that may be present in the insert 510 or directly in the upper chassis part 702 of the modular light bulb 100. The adapter unit 600 is used for electrically connecting the driver unit 500 to the light source unit 400. The adapter unit 600 is an independent component which may be manufactured and offered separately. The adapter unit 600 has two sides, one side facing to the light source unit 400 and the opposite side facing to the driver unit 500. A socket having two socket holes 602 and 604 for receiving the rigid conductors 412 and 414 of the light source unit 400 is formed on the side facing the light source unit 400 and a socket having two socket holes 606 and 608 for receiving the rigid conductors 502 and 504 of the driver unit 500 is formed on the side facing the driver unit 500. In the example shown, the distance between socket holes 606 and 608 is larger than the distance between the socket holes 602 and 604. Within the adapter unit 600, conductive springs 610 are thus used to electrically connect the rigid conductors 412 and 414 to the rigid conductors 502 and 504, respectively, when both the light source unit 400 and the driver unit 500 are plugged into the adapter unit 600. It will be readily apparent to one of ordinary skill in the art that the principle of the present disclosure can be practiced without the use of an adapter unit, for example, by overextending the rigid conductors protruding from the light source unit 400 to plug in directly into a socket formed at the driver unit 500.

Figure 7:
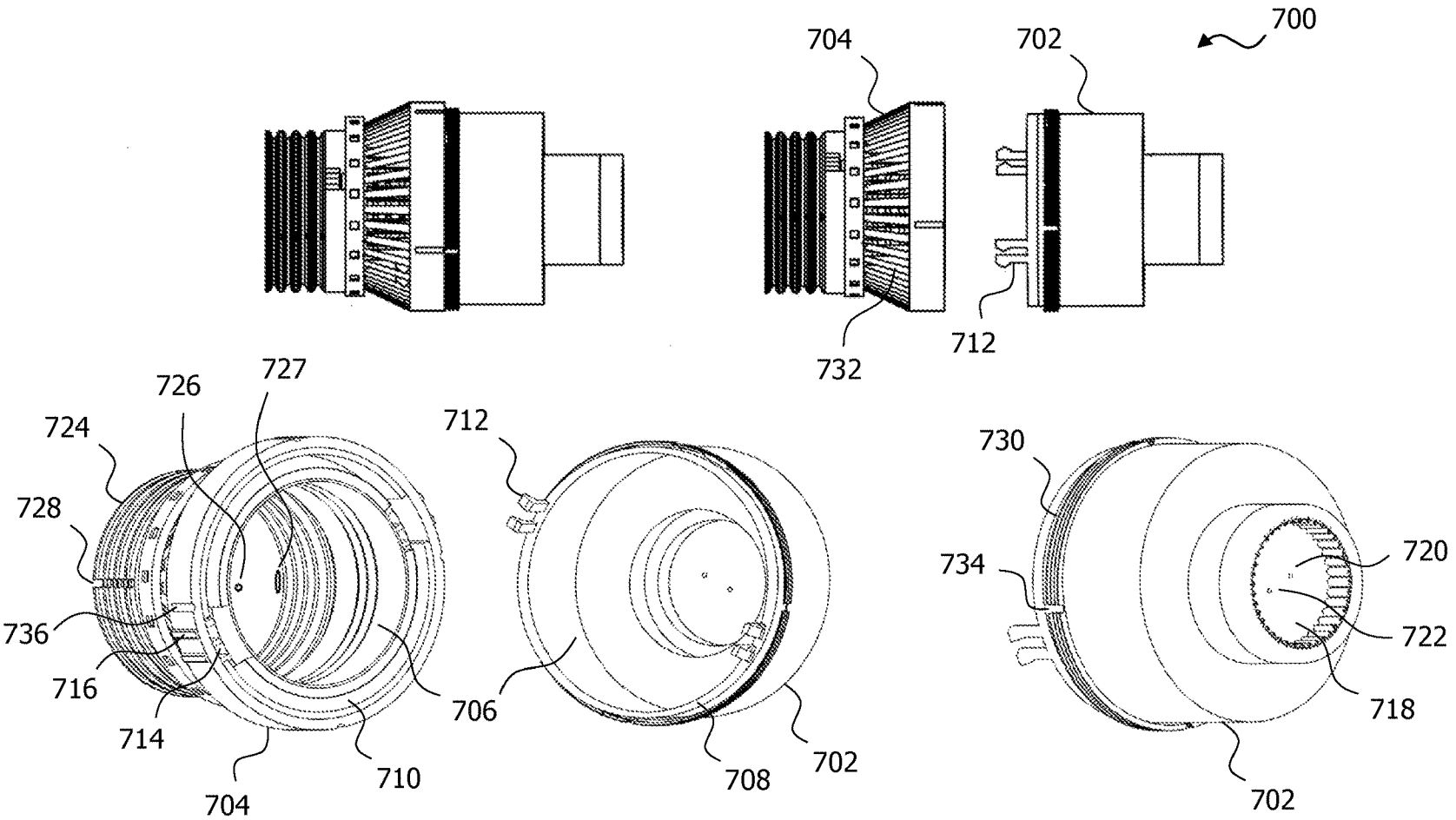
FIG. 7 illustrates the chassis unit of the modular light bulb with the lower chassis part and the upper chassis part in different perspective views.

FIG. 7 illustrates the chassis unit 700 of the modular light bulb 100 with the upper chassis part 702 and the lower chassis part 704 in different perspective views. The chassis unit 700 is an independent component which may be manufactured and offered separately. The chassis unit 700 forms the central component of the modular light bulb 100 to which other components of the modular light bulb 100 can be releasably fastened. Also, the chassis unit 700 provides a compartment 706 for removably accommodating the (insert enclosed) driver unit 500 therein.

For releasably fastening the upper chassis part 702 and the lower chassis part 704 to one another in the exemplary embodiment described herein, the upper chassis part 702 has a lip 708 and the lower chassis part 704 has a corresponding groove 710 having a mating shape into which the lip 708 may extend to generate an interference fit therewith. The interference fit is achieved by a slightly deviated size of the lip 708 and the groove 710 so that, when one part is pressed onto the other, the occupation of space results in a slight elastic deformation that creates a friction force allowing the lip 708 and the groove 710 to fasten and unfasten. A rubber washer may be disposed in the groove 710 to increase the interference fit.

Further, once the lip 708 and the groove 710 are pressed onto one another, a locking mechanism, such as in the exemplary embodiment described herein a snap fit lever hook mechanism, also known as a Cantilever Snap Joint mechanism, may be used to releasably lock the upper chassis part 702 and the lower chassis part 704 together. For this purpose, in the exemplary embodiment described herein, the upper chassis part 702 comprises lever hooks 712 protruding therefrom in the direction towards the lower chassis part 704 which comprises mating holes 714 to receive the lever hooks 712. When pressed into the mating holes 714, the lever hooks 712 deflect off the edges of the holes 714 and then return to their original shape while tapered at the edges of the holes 714. Finally, the stress along the length of the levers returns back to the natural form (cf. FIG. 10, middle). For facilitating assembly, the chassis unit 700 may comprise assembly guide rails 716 formed at the lower chassis part 704.

For releasably fastening the light source 400 onto the chassis unit 700 in the exemplary embodiment described herein, the upper chassis part 702 comprises a slot 718 for receiving the base 402 of the light receiving unit 400 which have mating shapes to form an interference fit once the base 402 is plugged into the slot 718. The interference fit is achieved by a slightly deviated size of the base 402 and the slot 718 so that, when one part is pressed onto the other, the occupation of space results in a slight elastic deformation that creates a friction force allowing the base 402 and the slot 718 to fasten and unfasten. Two holes 720 and 722 are provided in the slot 718 which align with the holes 512 and 514 of the insert 510 when the insert 510 is accommodated within the chassis unit 700. In this way, the rigid conductors 412 and 414 of the light source unit 400 may be plugged into the adapter unit 600 through the holes 720 and 722.

For releasably fastening the base unit 800 onto the chassis unit 700 in the exemplary embodiment described herein, the lower chassis part 704 comprises a threaded portion 724 which is engageable with a mating threaded portion of the base unit 800 so that the base unit 800 is fastened to the lower chassis part 704 in a form-locking manner when the respective threaded portions are engaged. A hole 726 is provided at the bottom of the lower chassis part 704 to allow the rigid conductor 506 extending from the driver unit 500 to pass through the lower chassis part 704 so as to allow the rigid conductor 506 to contact a portion of the base unit 800 for the purpose of establishing electrical connectivity. Also, a hole 727 is provided at the bottom of the lower chassis part 704 to allow the rigid conductor 508 extending from the driver unit 500 to pass through the lower chassis part 704 so as to allow the rigid conductor 508 to contact a portion of the base unit 800 for the purpose of establishing electrical connectivity. Further, the lower chassis part 704 comprises a groove 728 in the threaded portion 724 so that the rigid conductor 508 extending from the driver unit 500 may be wrapped around the lower chassis part 704 to extend into the groove 728. In this way, the rigid conductor 508 may be sandwiched between the base unit 800 and the lower chassis part 704 when the base unit 800 is fastened onto the chassis unit 700.

For releasably fastening the optical unit 900 onto the chassis unit 700 in the exemplary embodiment described herein, the upper chassis part 702 comprises a threaded portion 730 which is engageable with a mating threaded portion 902 of the optical unit 900 so that the optical unit 900 is fastened to the upper chassis part 702 in a form-locking manner when the respective threaded portions are engaged.

The chassis unit 700 may further exhibit heat-sink characteristics to function as an inactive heat exchanger that cools the modular light bulb 100 by dissipating heat into the surrounding area. For this purpose, in the exemplary embodiment described herein, the lower chassis part 704 comprises fins 732 having apertures in between to allow heat generated by the (insert enclosed) driver unit 500 to dissipate to the surrounding area. Further, the upper chassis part 702 comprises grooves 734 in the threaded portion 730 and the lower chassis part 704 comprises grooves 736 to form apertures that allow heat generated by the light source unit 400 to dissipate to the surrounding area when the optical unit 900 is fastened onto the chassis unit 700. Heat generated by the driver unit 500, in turn, may dissipate from the insert 510 through the apertures 516 and then through the fins 732 to the surrounding area.

Figure 8:
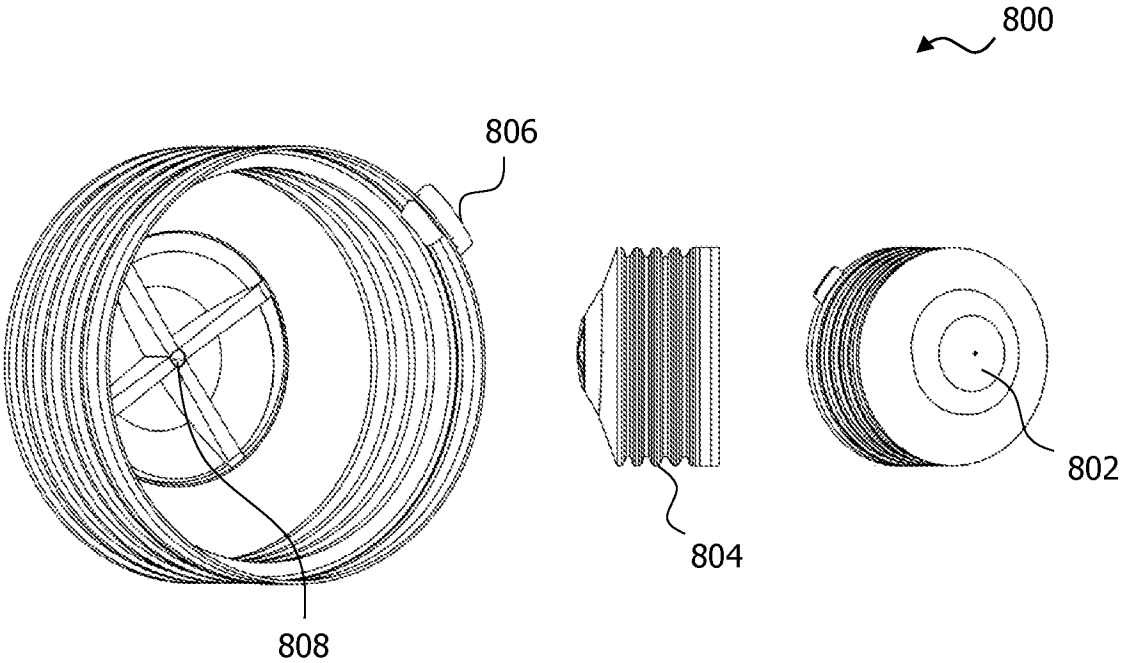
FIG. 8 illustrates the base unit of the modular light bulb in different perspective views.

FIG. 8 illustrates the base unit 800 of the modular light bulb 100 in different perspective views. The base unit 800 is an independent component which may be manufactured separately. The base unit 800 is engageable with a light bulb socket and may be given as a standard bi-pin base. It will be readily apparent to one of ordinary skill in the art, however, that the principles of the present disclosure can be practiced using other base types, such as, for example, E also known as ES or Edison Screw Bases, B also known as BA or Bayonet bases, G, GY, R, GZ, GX, GU, RX, FLAT, PEG, SCC and similar light bulb bases that may operate under the principles of the present disclosure.

The base unit 800 comprises a first portion 802 and a second portion 804 electrically isolated from one another. The first portion 802 and the second portion 804 form electrical contact points for use with a light bulb socket and may have a different electrical polarity (positive or negative) when the base unit 800 is engaged within a light bulb socket and receives electrical current therefrom.

For releasably fastening the base unit 800 onto the chassis unit 700 in the exemplary embodiment described herein, the second portion 804 of the base unit 800 comprises a threaded portion which mates the threaded portion 724 of the lower chassis part 704 and is engageable therewith. When a rotational force is applied, the helix of the corresponding thread portions allow the base unit 800 to be fastened or unfastened to or from the lower chassis part 704, depending on the rotational direction applied.

Further, once the base unit 800 is screwed onto the chassis unit 700 in this manner, a locking mechanism, such as in the exemplary embodiment described herein a snap fit lever hook mechanism, also known as a Cantilever Snap Joint mechanism, may be used to releasably lock the base unit 800 and the lower chassis part 704 together. The second portion 804 of the base unit 800 therefore comprises a lever hook 806 which may slide into a corresponding mating hole 738 provided in the lower chassis part 704 (cf. FIG. 10, left). Once the lever hook 806 passes a latch edge provided at the lower chassis part 704, the lever hook 806 deflects while passing the edge of the mating hole 738 and then returns to its original shape with the beam of the lever hook 806 tapered below the mating hole 738. Finally, the stress along the length of the lever hook 806 returns to its natural form to become evenly distributed, thus, locking the base unit 800 and the chassis unit 700 together.

The base unit 800 further comprises a retaining hole 808 formed at the first portion 802 the base unit 800 for receiving and affixing the first rigid conductor 506 from the driver unit 500 when the driver unit 500 is accommodated within the chassis unit 700 and when the base unit 800 is fastened onto the lower chassis part 704. In this way, the first portion 802 and the first rigid conductor 506 are brought into contact, thereby enabling electrical connectivity between the base unit 800 and the driver unit 500.

It will be understood that affixing the first rigid conductor 506 into the retaining hole 808 formed at the first portion 802 at a bottom center part of the base unit 800 is just one example of contacting the first portion 802 by the first rigid conductor 506. It will be readily apparent to one of ordinary skill in the art that other forms of contact between the first portion 802 and the first rigid conductor 506 are conceivable. The same basically applies to the second rigid conductor 508 which does not necessarily have to be wrapped around the lower chassis part 704 to extend into the groove 728 in order to contact the second portion 804 of the base unit 800. It will be readily apparent to one of ordinary skill in the art that other forms of contact between the second portion 804 and the second rigid conductor 508 are conceivable.

Figure 9:
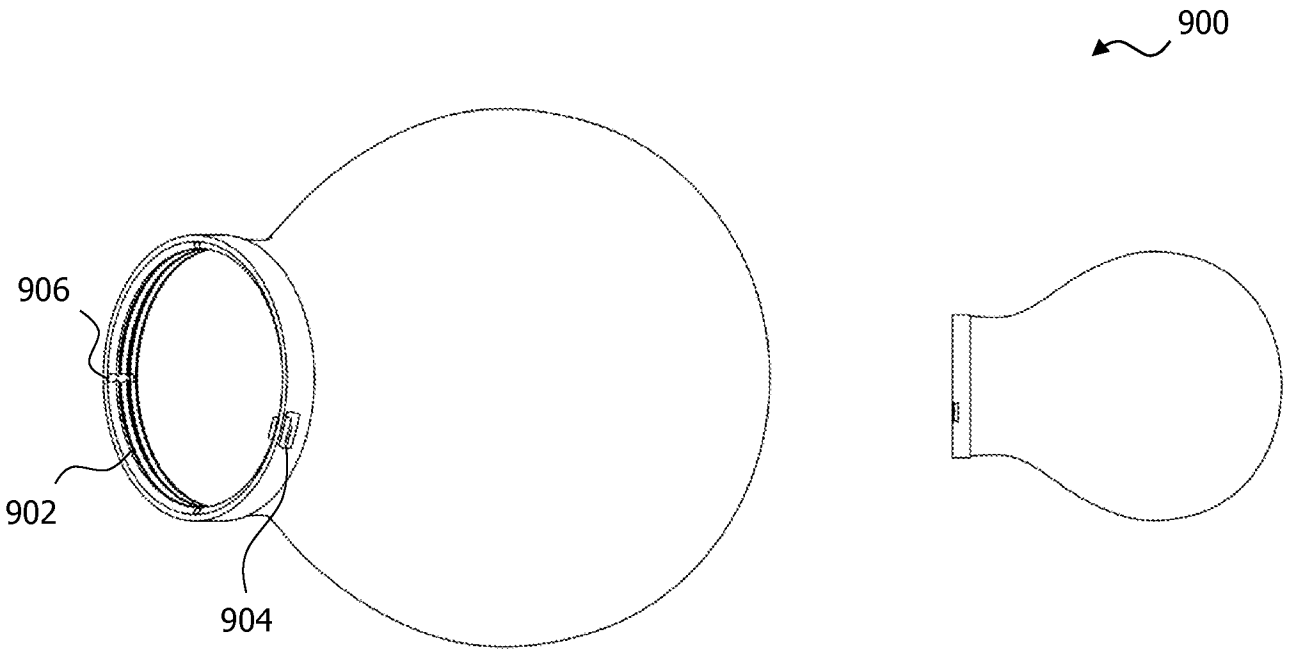
FIG. 9 illustrates the optical unit of the modular light bulb in different perspective views.
Figure 10:
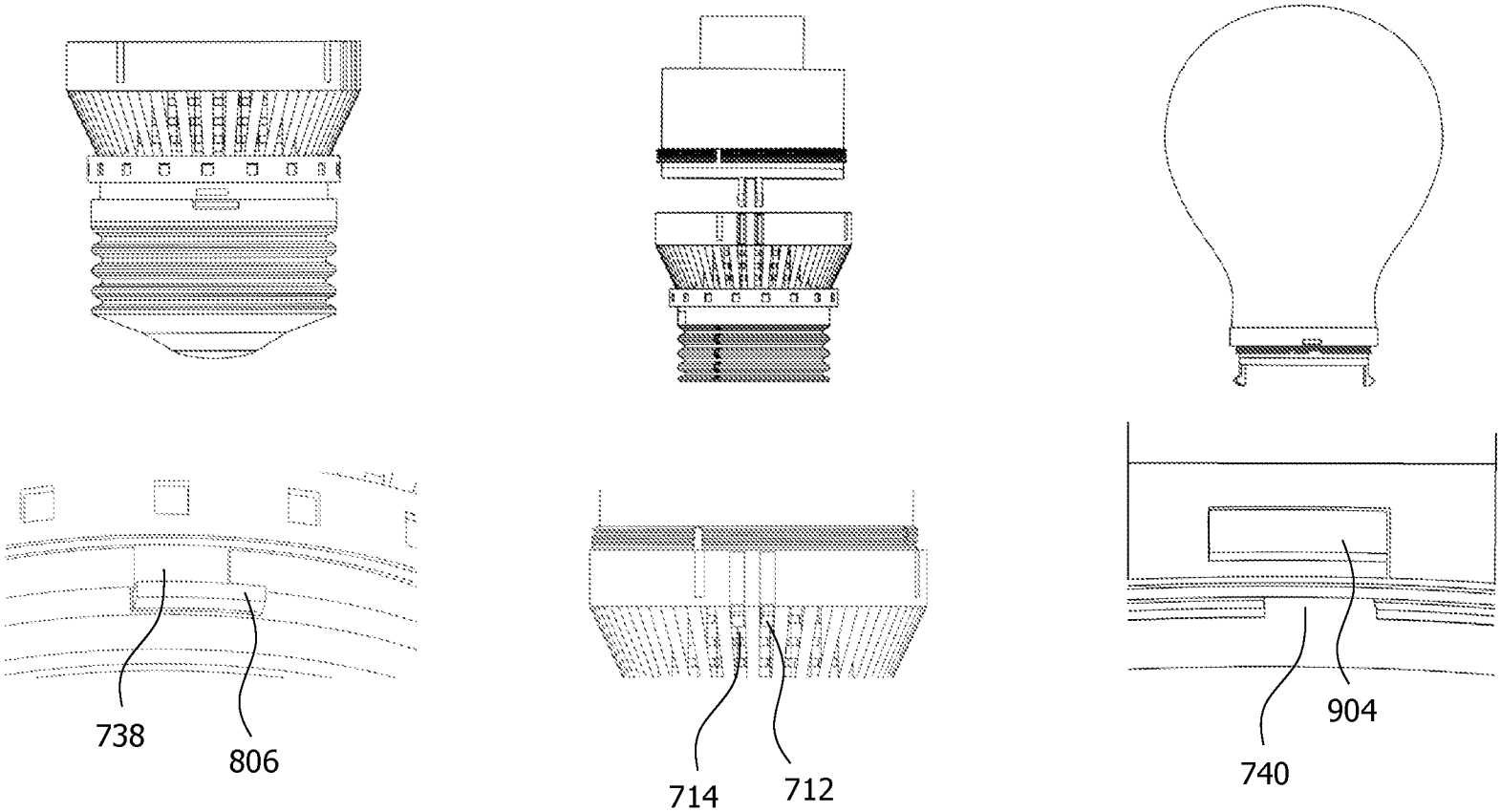
FIG. 10 illustrates locking mechanisms used between the base unit and the lower chassis part, between the lower and the upper chassis part, and between the upper chassis part and the optical unit.

FIG. 9 illustrates the optical unit 900 of the modular light bulb 100 in different perspective views. The optical unit 900 is an independent component which may be manufactured and offered separately. The optical unit 900 is a translucent optical lens for the purpose of protecting the light source unit 400. The optical unit 900 may come in various finishing types, including different colors and frosted finishing, for example.

For releasably fastening the optical unit 900 onto the chassis unit 700 in the exemplary embodiment described herein, the optical unit 900 comprises at its bottom a threaded portion 902 which mates the threaded portion 730 of the upper chassis part 702 and is engageable therewith. When a rotational force is applied, the helix of the corresponding thread portions allow the optical unit 900 to be fastened or unfastened to or from the upper chassis part 702, depending on the rotational direction applied.

Further, once the optical unit 900 is screwed onto the chassis unit 700 in this manner, a locking mechanism, such as in the exemplary embodiment described herein a snap fit lever hook mechanism, also known as a Cantilever Snap Joint mechanism, may be used to releasably lock the optical unit 900 and the upper chassis part 702 together. The optical unit 900 therefore comprises a lever hook 904 which may slide into a corresponding mating hole 740 provided in the upper chassis part 702 (cf. FIG. 10, right). Once the lever hook 904 passes a latch edge provided at the upper chassis part 702, the lever hook 904 deflects while passing the edge of the mating hole 740 and then returns to its original shape with the beam of the lever hook 904 tapered below the mating hole 740. Finally, the stress along the length of the lever hook 904 returns to its natural form to become evenly distributed, thus, locking the optical unit 900 and the chassis unit 700 together.

For heat dissipation purposes, grooves 906 are formed in the threaded portion 902 of the optical unit 900 which align with grooves 734 formed in the upper chassis part 702 when the optical unit 900 is fastened onto the upper chassis part 702 to form apertures that allow heat generated by the light source unit 400 to dissipate to the surrounding area when the optical unit 900 is fastened onto the chassis unit 700.

Figure 11:
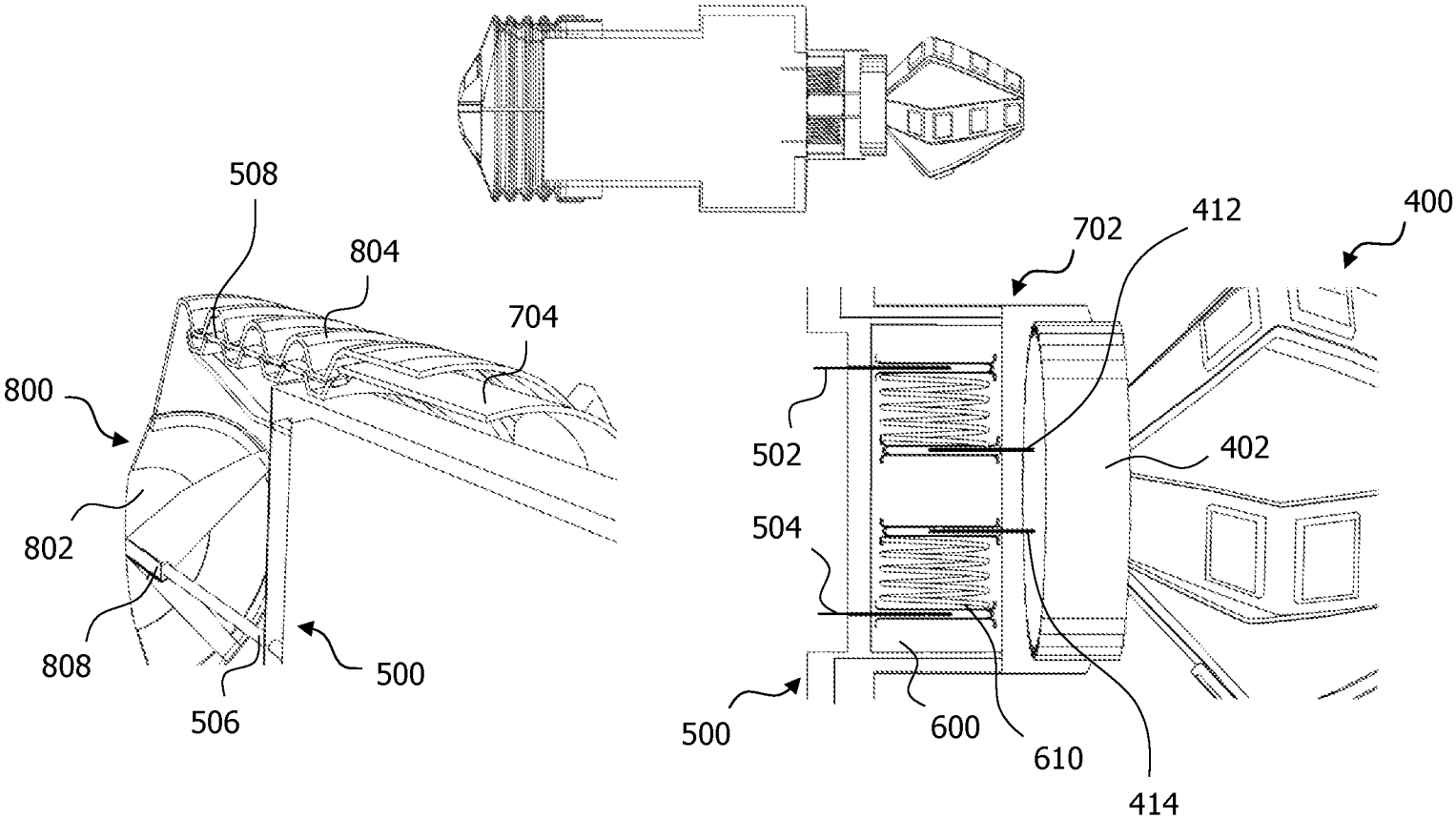
FIG. 11 illustrates the electrical connections between the base unit and the driver unit as well as between the driver unit and the light source unit of the modular light bulb.

FIG. 11 illustrates the electrical connections between the base unit 800 and the driver unit 500 as well as between the driver unit 500 and the light source unit 400 of the modular light bulb 100 when the modular light bulb 100 is in an assembled state.

As may be seen in the left portion of FIG. 11, the rigid conductor 506 which extends out of the lower chassis part 704 from the (insert enclosed) driver unit 500 is received by the retaining hole 808 formed at the first portion 802 of the base unit 800. A contact between the rigid conductor 506 and the first portion 802 of the base unit 800 is thus created. Further, the rigid conductor 508 which extends out of the lower chassis part 704 from the (insert enclosed) driver unit 500 is wrapped around (e.g., with a push of a finger) the lower chassis part 704 to extend into groove 728 (shown in FIG. 7) formed at the outside of the lower chassis part 704.

When the base unit 800 is screwed onto the lower chassis part 704, as depicted in FIG. 11, the rigid conductor 508 is sandwiched between the second portion 804 of the base unit 800 and the lower chassis part 704. A contact between the rigid conductor 508 and the second portion 804 of the base unit 800 is thus created and a releasable electrical connection between the base unit 800 and the driver unit 500 is therefore established.

As may be seen in the right portion of FIG. 11, the light source unit 400 is fastened onto the upper chassis part 702 by pushing the base 402 of the light source unit 400 into the slot 718 formed at the upper chassis part 702 to form an interference fit therewith. The rigid conductors 412 and 414 extending from the base 402 of the light source unit 400 are guided through holes 720 and 722 formed in the slot 718 (shown in FIG. 7) so that the rigid conductors 412 and 414 are plugged into socket holes 602 and 604 of the adapter unit 600.

Further, the rigid conductors 502 and 504 extending from the driver unit 500 are plugged into the socket holes 606 and 608 at the other side of the adapter unit 600 and, within the adapter unit 600, a first conductive spring 610 is used to connect rigid conductors 412 and 502 to one another and a second conductive spring 610 is used to connect rigid conductors 414 and 504 to one another. A releasable electrical connection between the light source unit 400 and the driver unit 500 is therefore established.

It will be understood that the modular light bulb 100 described herein is merely exemplary and not limited to the above-describe specific characteristics. In particular, one skilled in the art will appreciate that the specific implementation of the fastening mechanisms described herein may be realized in various other forms.

It is thus not obligatory, for example, to use a screw thread to releasably fasten the optical unit onto the upper chassis part and to releasably fasten the base unit to the lower chassis part. Also, it is not obligatory to use an interference fit to releasably fasten the upper and the lower chassis part to one another or to releasably fasten the light source unit onto the upper chassis part. It will be readily apparent to one of ordinary skill in the art that the principles of the present disclosure can be practiced using other releasable fastening techniques, such as, for example, an anchor bolt, batten, brass fastener, buckle, button, cable, captive fastener, clamp (or cramp), clasps, cleko, clips, clutch, drawing pin (thumbtack), flange, frog, grommet, hook-and-eye closure, hook and loop fastener, latch, nail, pegs, PEM nut, pins, retaining rings, rivet, rubber band (or bands of other materials), screw anchor, snap fastener, staple, stitches, strap, tie, toggle bolt, treasury tag, twist tie, wedge anchor, zipper, or other fastening techniques that may operate under the principles of the present disclosure.

Similarly, it is not obligatory to use a snap fit lever hook mechanism, also known as a Cantilever Snap Joint locking mechanism, to releasably lock the position of the optical unit relative to the upper chassis part, to releasably lock the position of the base unit relative to the lower chassis part, or to releasably lock the position of the upper and the lower chassis part relative to one another. It will be readily apparent to one of ordinary skill in the art that the principles of the present disclosure can be practiced using other releasable locking techniques such as, for example, Spring latches, Threaded turn lock, Deadbolt latch, Slam latch, Cam lock, Norfolk latch, Snap latches, Suffolk latch, Crossbar, Cabin hook, Bolt lock latch, barrel bolt latches, Compression latch, Draw latch (both over- and under-center), Rotary latch or other locking techniques that may operate under the principles of the present disclosure.

Further, if the modular light bulb 100 is to be used as an outdoor light bulb, additional measures may be taken for water proofing the modular light bulb 100. For this purpose, one or more of the components of the modular light bulb 100 may be treated with a breathable silicon based substance that prevents water from affecting the respective components. The breathable silicon based substance may come in a liquid form which may be poured onto the electrical components and left to dry and harden. Once the substance dries and hardens, water does not affect electrical connections, thus, eliminating electrical shorts and corrosion. For example, the insert 510 may be treated with a breathable silicon based substance for such purposes. As another example for such measure, a water proof seal may be provided in the region where the base unit 800 and the lower chassis part 704 are fastened together in order to prevent water from entering in.

Figure 12:
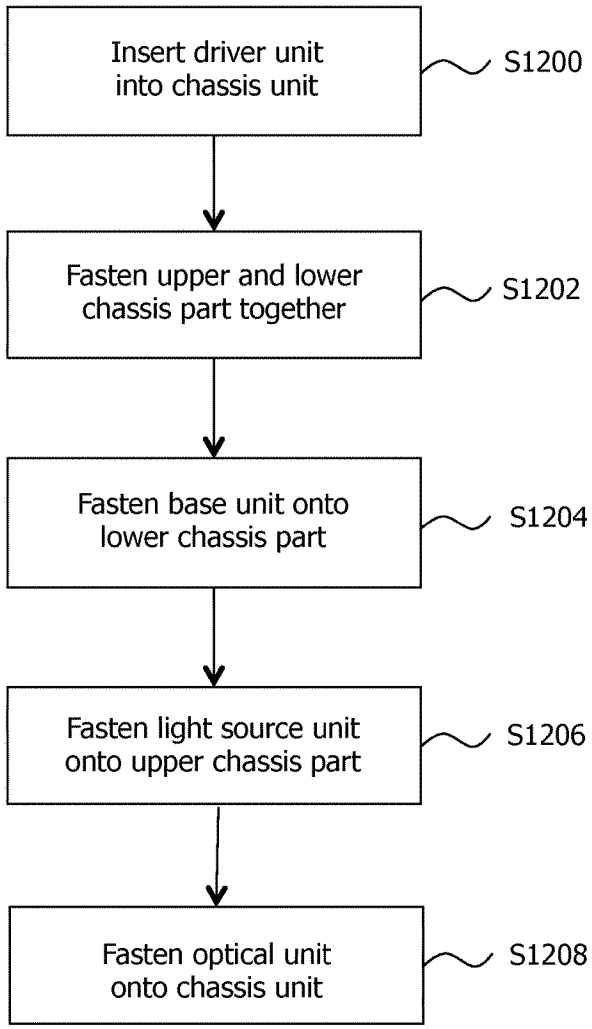
FIG. 12 schematically illustrates a flowchart of a method of assembling the modular light bulb.

FIG. 12 schematically illustrates a flowchart of a method of assembling the modular light bulb 100. In step S1200, the pre-assembled (insert enclosed) driver unit 500 is inserted into the chassis unit 700 to be accommodated within the chassis unit 700. In step S1202, the upper chassis part 702 and the lower chassis part 704 are fastened to one another so that the (insert and closed) driver unit 500 is fastened into position within the chassis unit 700.

In step S1204, the base unit 800 is fastened onto the lower chassis part 704. For this purpose, the rigid conductor 508 extending through the hole 727 out of the lower chassis part 704 from the (insert enclosed) driver unit 500 is wrapped around (e.g., with a push of a finger) the lower chassis part 704 to extend into the groove 728 formed at the outside of the lower chassis part 704. The base unit 800 is then screwed onto the threaded portion 724 of the lower chassis part 704 so that the rigid conductor 508 is sandwiched between the second portion 804 of the base unit 800 and the lower chassis part 704, thus, creating contact between the rigid conductor 508 and the second portion 804 of the base unit 800. Further, when screwing the base unit 800 onto the lower chassis part 704, the rigid conductor 506 extending through the hole 726 out of the lower chassis part 704 from the (insert enclosed) driver unit 500 is received by the retaining hole 808 formed at the first portion 802 of the base 800, thus, creating contact between the rigid conductor 506 and the first portion 802 of the base unit 800. A releasable electrical connection between the base unit 800 and the driver unit 500 is thus established.

In step S1206, the light source unit 400 is fastened onto the upper chassis part 702. For this purpose, the base 402 of the light source unit 400 is pushed into the slot 718 formed at the upper chassis part 702 while guiding rigid conductors 412 and 414 extending from the light source unit 400 through holes 720 and 722 formed in the slot 718 so that rigid conductors 412 and 414 are plugged into socket holes 602 and 604 of the adapter unit 600. Since the rigid conductors 502 and 504 extending from the driver unit 500 are already plugged into socket holes 606 and 608 at the other side of the adapter unit 600 within the insert 510, a releasable electric connection between the light source unit 400 and the driver unit 500 is thus established.

Finally, in step S1208, the optical unit 900 is releasably fastened onto the chassis unit 700 by screwing the threaded portion 902 of the optical unit 900 onto the threaded portion 730 of the upper chassis part 702.

In order to disassemble the modular light bulb 100, corresponding unfastening steps may be performed. Disassembling the modular light bulb 100 may be required, for example, if one or more components of the bulb need replacement. A replacement requirement may be identified, for example, by observation including visual identification, scent and a process of elimination. For example, if the optical unit 900 breaks, a user may be able to visually identify that a replacement of the optical unit is required. As another example, if the driver unit 500 stops functioning, a user may be able to identify a darkened part or a smell indicating the presence of burned material. The chassis unit 700 and the base unit 800, on the other hand, can be expected to have a long life expectancy unless they are physically and accidentally damaged. Such defect may be identifiable by a user as well.

As has become apparent from the above description, due to the modularity of the modular light bulb, due to the releasability of the fastening techniques used to connect the respective components of the bulb together, and due to the releasability of the electrical connections formed between the respective components, the respective components of the modular light bulb according to the present disclosure may be assembled and disassembled in an adhesive-less, solder-less and tool-less manner. As a consequence, the bulb does not need to be trashed entirely when it breaks. Components that are still in good working condition may be replaced or recycled. Manufacturing defects, defective material, accidental damages of the bulb or even bulb performance upgrades can be handled easily by simply replacing one or more respective components of the bulb.

The bulb is generally serviceable or upgradable by a layperson because no tools are required for assembly or disassembly. Factory assembly and the corresponding costs may thus be avoided. As to the assembly, four soldering points for electrically connecting the driver unit to the base unit and four soldering points for electrically connecting the driver unit to the light source unit typically used in prior art light bulbs are dispensable. Also, adhesive material or thermal bonding typically used in prior art light bulbs to fasten the optical unit onto the chassis unit and to fasten the base unit to the chassis unit of the bulb is not needed.

It is believed that the advantages of the modular light bulb presented herein will be fully understood from the foregoing description, and it will be apparent that various changes may be made in the form, constructions and arrangement of the exemplary aspects thereof without departing from the scope of the invention or without sacrificing all of its advantageous effects. Because the modular light bulb presented herein can be varied in many ways, it will be recognized that the invention should be limited only by the scope of the claims that follow.

The invention claimed is:

1. A chassis unit for use in a modular light bulb, the chassis unit comprising:

an upper chassis part and a lower chassis part, the upper chassis part including a slot at an inside portion of a first end, a threaded surface at the first end, and a lip at an opposite second end, the slot configured to receive the base member and form a friction fit coupling, and the threaded surface configured to receive the threaded mouth of the optical unit, the lower chassis part including a groove at one end and a threaded portion at an opposite end, the groove configured to receive the lip of the upper chassis part and form a friction fit coupling to form a combination of an upper chassis part and a lower chassis part, wherein the chassis unit is configured to removably accommodate therein a driver unit of the modular light bulb, wherein the lower chassis part is configured to releasably fasten thereon a base unit of the modular light bulb, wherein the upper chassis part is configured to releasably fasten thereon a light source unit of the modular light bulb, and wherein the chassis unit is configured to releasably fasten thereon an optical unit of the modular light bulb.

2. The chassis unit of claim 1, wherein the lower chassis part is fastened to the base unit using a form-lock and wherein a groove is formed at the outside of the lower chassis part in a region of the form-lock so that a rigid conductor of the driver unit is sandwichable between the base unit and the lower chassis part.

3. The chassis unit of claim 1, further comprising fins for heat dissipation on its outside.

4. The chassis unit of claim 1, wherein the optical unit is fastened to the chassis unit using a form-lock and wherein the chassis unit comprises at least one groove in a region of the form-lock so that the at least one groove forms an aperture for heat dissipation.

5. The chassis unit of claim 1, wherein the upper chassis part and the lower chassis part are configured to be releasably fastened to one another using a releasable locking mechanism.

6. A modular light bulb comprising:

a light source unit having a base member;

an optical unit configured to enclose the light source unit, and including a threaded mouth;

a driver unit configured to be electrically connected to the light source unit;

a base unit configured to be received in a light bulb socket and to be electrically connected to the driver unit;

an upper chassis part including a slot at an inside portion of a first end, a threaded surface at the first end, and a lip at an opposite second end, the slot configured to receive the base member and form a friction fit coupling, and the threaded surface configured to receive the threaded mouth of the optical unit; and a lower chassis part including a groove at one end and a threaded portion at an opposite end, the groove configured to receive the lip of the upper chassis part and form a friction fit coupling to form a combination of an upper chassis part and a lower chassis part, wherein the driver unit is removably received within the combination of the upper chassis part and the lower chassis part, an electrical connection is formed when the base unit of the light source unit received in the slot of the upper chassis part, and the base unit is coupled to the threaded portion of the lower chassis part to form an electrical connection with the driver unit, and wherein the driver unit, the light source, the optical unit and the base unit provide for easy and quick independent replacement of any one of the driver unit, light source, optical unit and base unit by user of the modular light bulb.

7. The modular light bulb of claim 6, wherein the electrical connection between the driver unit and the light source unit comprises a plug and socket connection formed between the driver unit and the light source unit.

8. The modular light bulb of claim 6, further comprising an adapter unit, wherein the electrical connection between the driver unit and the light source unit comprises a plug and socket connection formed between the driver unit and the adapter unit and a plug and socket connection formed between the adapter unit and the light source unit.

9. The modular light bulb of claim 6, wherein the chassis unit comprises fins for heat dissipation on its outside.

10. The modular light bulb of claim 6, wherein the optical unit is fastened to the chassis unit using a form-lock and wherein the chassis unit comprises at least one groove in a region of the form-lock so that the at least one groove forms an aperture for heat dissipation.

11. The modular light bulb of claim 6, wherein a locking mechanism is used for releasably fastening at least one of the upper chassis part and the lower chassis part to one another, the base unit onto the lower chassis part, the light source unit onto the upper chassis part, and the optical unit onto the chassis unit.

12. The modular light bulb of claim 6, wherein the electrical connection between the driver unit and the light source unit comprises at least one plug and socket connection.

13. The modular light bulb of claim 12, wherein a plug for the plug and socket connection is formed of two rigid conductors extending from the light source unit.

14. The modular light bulb of claim 6, wherein the base unit comprises a first portion and a second portion electrically isolated from one another, wherein the electrical connection between the driver unit and the base unit comprises a first rigid conductor extending from the driver unit and contacting the first portion of the base unit and a second rigid conductor extending from the driver unit and contacting the second portion of the base unit.

15. The modular light bulb of claim 14, wherein the first rigid conductor is received in a retaining hole formed at the first portion of the base unit.

16. The modular light bulb of claim 14, wherein the base unit is fastened to the lower chassis part using a form-lock between the second portion of the base unit and the lower chassis part and wherein the second rigid conductor is wrapped around the lower chassis part to extend into a groove formed at the outside of the lower chassis part in a region of the form-lock so that the second rigid conductor is sandwiched between the second portion of the base unit and the lower chassis part.

17. The modular light bulb of claim 6, wherein the driver unit is enclosed in an insert fitting into the chassis unit.

18. The modular light bulb of claim 17, wherein an adapter unit used for electrically connecting the driver unit to the light source unit is enclosed in the insert.

19. The modular light bulb of claim 17, wherein the insert includes at least one aperture for heat dissipation.

20. A method of assembling a modular light bulb, the method comprising:

inserting a driver unit into a combination of an upper chassis part and a lower chassis part having an upper chassis part and a lower chassis part, the upper chassis part including a slot at an inside portion of a first end, a threaded surface at the first end, and a lip at an opposite second end, the slot configured to receive the base member and form a friction fit coupling, and the threaded surface configured to receive the threaded mouth of the optical unit and the lower chassis part including a groove at one end and a threaded portion at an opposite end, the groove configured to receive the lip of the upper chassis part and form a friction fit coupling to form a combination of an upper chassis part and a lower chassis part;

fastening the upper chassis part and the lower chassis part to one another;

fastening a threaded portion of a base unit onto a threaded portion of the lower chassis part, wherein fastening the base unit onto the lower chassis part comprises establishing a releasable electrical connection between the base unit and the driver unit, the base unit being configured to be received in a light bulb socket;

fastening a light source unit onto the upper chassis part by fitting the light source unit into a slot of the upper chassis part to form an interference fit, wherein fastening the light source unit onto the upper chassis part comprises establishing a releasable electrical connection between the driver unit and the light source unit, the driver unit being configured to drive the light source unit; and fastening a threaded mouth of an optical unit onto a threaded portion of the chassis unit, so that the optical unit encloses the light source unit, wherein the driver unit, the light source, the optical unit and the base unit provide for easy and quick independent replacement of any one of the driver unit, light source, optical unit and base unit by user of the modular light bulb.

* * * * *